US007306046B2

(12) United States Patent
Meixner et al.

(10) Patent No.: US 7,306,046 B2
(45) Date of Patent: Dec. 11, 2007

(54) PORTABLE POWER TOOL

(75) Inventors: Gerhard Meixner, Filderstadt (DE); Markus Leupert, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 198 days.

(21) Appl. No.: 10/549,414

(22) PCT Filed: Sep. 25, 2004

(86) PCT No.: PCT/DE2004/002148

§ 371 (c)(1),
(2), (4) Date: Sep. 14, 2005

(87) PCT Pub. No.: WO2005/046940

PCT Pub. Date: May 26, 2005

(65) Prior Publication Data

US 2006/0260831 A1 Nov. 23, 2006

(30) Foreign Application Priority Data

Nov. 13, 2003 (DE) ..... 103 53 013

(51) Int. Cl.
*B25F 5/056* (2006.01)

(52) U.S. Cl. ..... 173/2; 173/176; 173/201; 173/217

(58) Field of Classification Search ..... 173/2, 173/176, 178, 216, 217, 201, 109; 408/6, 408/9, 124
See application file for complete search history.

(56) References Cited

U.S. PATENT DOCUMENTS

| | | | | |
|---|---|---|---|---|
| 4,448,261 | A * | 5/1984 | Kousek et al. | 173/176 |
| 4,553,326 | A | 11/1985 | West | |
| 5,879,111 | A | 3/1999 | Stoeck et al. | |
| 5,996,707 | A | 12/1999 | Thome et al. | |
| 6,415,875 | B1 * | 7/2002 | Meixner et al. | 173/2 |
| 6,681,869 | B2 * | 1/2004 | Wursch et al. | 173/2 |
| 6,843,327 | B2 * | 1/2005 | Meixner et al. | 173/11 |
| 6,981,557 | B2 * | 1/2006 | Boeni et al. | 173/1 |
| 7,055,620 | B2 * | 6/2006 | Nadig et al. | 173/2 |

FOREIGN PATENT DOCUMENTS

| | | |
|---|---|---|
| DE | 37 07 052 A1 | 9/1988 |
| DE | 43 00 021 A1 | 7/1994 |
| FR | 2 526 359 | 11/1983 |
| GB | 2 273 904 A | 7/1994 |

* cited by examiner

*Primary Examiner*—Scott A. Smith
(74) *Attorney, Agent, or Firm*—Michael J. Striker

(57) ABSTRACT

A hand power tool has an electric motor, which is located in a housing and by way of which a tool insert located in a tool retainer is drivable in rotation, a guard device with which an uncontrollable blockage of the tool insert is detectable via a sensor unit and with which the housing is blockable in its motion; the guard device includes a mechanical unlocking unit that is manually actuatable by a user's action force, and gear is actuatable via an on/off switch for actuating the unlocking unit.

16 Claims, 3 Drawing Sheets

PORTABLE POWER TOOL

CROSS-REFERENCE TO A RELATED APPLICATION

The invention described and claimed hereinbelow is also described in German Patent Application DE 10353013.4 filed on Nov. 13, 2003. This German Patent Application provides the basis for a claim of priority of invention under 35 U.S.C. 119(a)-(d).

BACKGROUND OF THE INVENTION

The invention is based on a hand power tool.

An uncontrollable blockage of a hand power tool exists if the tool insert seizes in the workpiece to be machined, the reaction torque operative at the housing exceeds a user's grasping force, and the housing rotates uncontrollably at a defined angular speed and over a defined angular range about an axis. If the user's grasping force is greater than the existing reaction torque, or if the user is grasping the hand power tool firmly during a blockage, then a so-called controllable blockage is involved.

From German Published Patent Disclosure DE 37 07 052 A1, a hand power tool is known that has an electric motor, located in a housing, by way of which a tool insert located in a tool retainer can be driven to rotate. The hand power tool has a guard device, with which, via a sensor, a so-called uncontrollable blockage of the tool insert can be ascertained. The rotary drive is interrupted by automatic disengagement of a clutch, located in the drive train, as a function of an overload variable, and thus the housing can be blocked in its motion. The clutch can immediately be engaged again mechanically by manually pressing a shift adjuster inward, causing it, with a lever, to compress a disengagement spring of the clutch.

SUMMARY OF THE INVENTION

The invention is based on a hand power tool having an electric motor, which is located in a housing and by way of which a tool insert located in a tool retainer is drivable in rotation, and having a guard device, with which an uncontrollable blockage of the tool insert is detectable via a sensor unit and with which the housing is blockable in its motion; the guard device includes a mechanical unlocking unit that is manually actuatable by a user's actuation force.

It is proposed that a gear is actuatable via an on/off switch means for actuating the unlocking unit. Thus the unlocking unit can be reliably tripped upon activation of the electric motor. The user's actuation force unlocks the guard device. The unlocking unit therefore requires no complicated electronic components and is especially fail-safe. Moreover, mechanical components are inexpensive and require no electrical power. The guard device can be tripped in the event of an uncontrollable blockage and reset and reactivated without particular effort when the hand power tool is switched back on again. Compared with electrical or electronic systems, the function of the guard device is simplified considerably. The mechanically actuatable unlocking unit can be combined with mechanical, electrical and electronic variants of sensor units and/or blocking units of a guard device. The gear can preferably be embodied as a cam gear. Optionally, a lever mechanism or some other mechanism that is considered appropriate by one skilled in the art may be provided. Especially advantageously, the on/off switch means is embodied as a switching latch, which is actuated by the user for switching the hand power tool on and off. Alternatively, the on/off switch means can also be integrated with the hand power tool in such a way that it is tripped when the tool or the hand power tool is pressed against a surface to be machined.

The unlocking unit is preferably actuated automatically via the on/off switch means when the electric motor is switched back on. Then the guard device can be newly activated without further action on the part of the user and is immediately ready for operation. It is assured that the electric motor will not start until the unlocking unit has been tripped and the guard device is again ready for use. The guard device of the hand power tool is convenient to operated.

If the guard device includes a mechanical sensor unit, a further simplification of the system and reduced vulnerability to malfunction are attained.

The sensor unit preferably has a restoring spring, which when the hand power tool is switched back on again automatically re-activates the sensor unit even after a blockage and makes it ready for operation.

In an alternative embodiment, the guard device includes an electric sensor unit. This makes it possible to use intelligent sensors in a mixed mechanical-electrical system, with a purely mechanical so-called reset and with an electric sensor unit.

If the guard device includes a mechanical blocking unit, then a purely mechanical guard device can be made that functions very reliably and makes high operating safety possible.

The blocking unit preferably has a rotatably supported detent lever, with a serration intended for engaging a blocking serration on one end and with an extension on its diametrically opposite end. In the event of an uncontrollable blockage, the blocking serration can block a rotation of the housing.

In an alternative embodiment, the guard device includes an electric blocking unit. This makes it possible to construct a mixed mechanical-electrical system, with a purely mechanical so-often reset and with an electric blocking unit.

If the unlocking unit has a switching rod, one end of which is connected to an on/off switch means and the other end of which is operatively connected to the blocking unit, then the blocking unit is actuatable via the unlocking unit.

Preferably, the switching rod is supported longitudinal displaceably along the axis of rotation. Thus a motion of the on/off switch means in the longitudinal direction can be utilized for actuating the switching rod.

In a preferred embodiment, the switching rod has a switching pawl and a switching cam, with which a motion in the longitudinal direction, tripped by an actuation of the on/off switch means, is convertable into an up-and-down motion, with a first, upper position and a second, lower position. With the up-and-down motion, the switching rod can assume at least two different operating states, for a blockage and for unlocking the guard device.

Preferably, on one end having an actuating pin, the switching rod engages the on/off switch means and on the other end, with a connecting part, it engages the extension of the detent lever. The detent lever can be actuated by an actuation of the on/off switch means.

Preferably, when the electric motor has been switched off and the on/off switch means has been tripped, the switching rod is located in the upper position. The switching rod thus assumes a neutral position, which remains without influence on the hand power tool. If a blockage has occurred, it can be maintained even if the on/off switch means is let go and the electric motor is switched off.

If upon actuation of the on/off switch means, the switching rod is movable into the lower position, and the detent lever is removable out of the blocking serration, then without further action of the user upon reactivation of the electric motor, the blocking serration is unlocked and the guard device is activated again. Preferably, in a first motion of the on/off switch means the guard device is reset and activated, and upon continuation of the motion the electric motor is then electrically switched on. It is thus assured that the electric motor is always in operation only when the guard device has been activated.

If for blocking the motion of the housing, a flow of torque is interruptable by means of a clutch, this prevents a motion of the housing. The clutch can be a clutch that can be operated mechanically or electrically.

If the electric motor and/or electrical components are capable of being switched off in the event of blockage, then energy can be saved. For manually unlocking the unlocking unit, the electric motor is already switched off, and the user can rapidly put the hand power tool back into operation. If the electric motor is switched off and an electric clutch is opened in order to interrupt the flow of torque in the event of a blockage, it can be assured that the housing remains blocked in its motion.

DRAWING

Further advantages will become apparent from the ensuing drawing description. In the drawing, one exemplary embodiment of the invention is shown. The drawing, description and claims include numerous characteristics in combination. One skilled in the art will expediently consider the characteristics individually as well and put them together to make useful further combinations.

DESCRIPTION OF THE PREFERRED EMBODIMENTS

Figure 1:
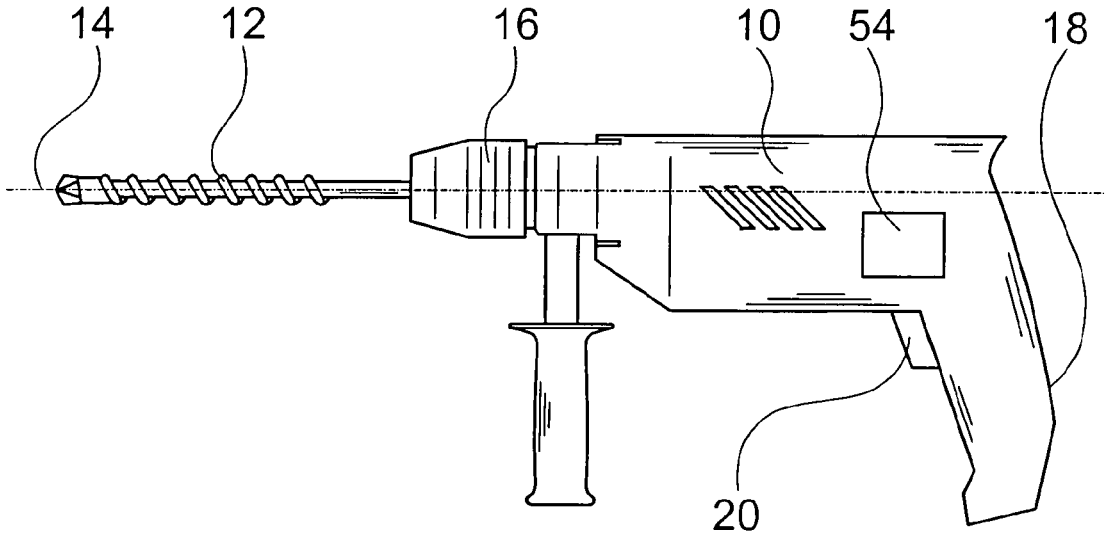
FIG. 1, a section through a preferred hand power tool.

FIG. 1 shows a hand power tool, with an electric motor, not shown, located in a housing 10. The electric motor drives a tool insert 12, located in a tool retainer 16, to rotate. A guard device 54 can be unlocked with an on/off switch means 20, embodied as a switching latch of an on/off switch, in a grip 18 of the hand power tool. If an uncontrollable blockage occurs, there is the risk that the housing 10 will rotate about an axis of rotation 14.

Figure 2:
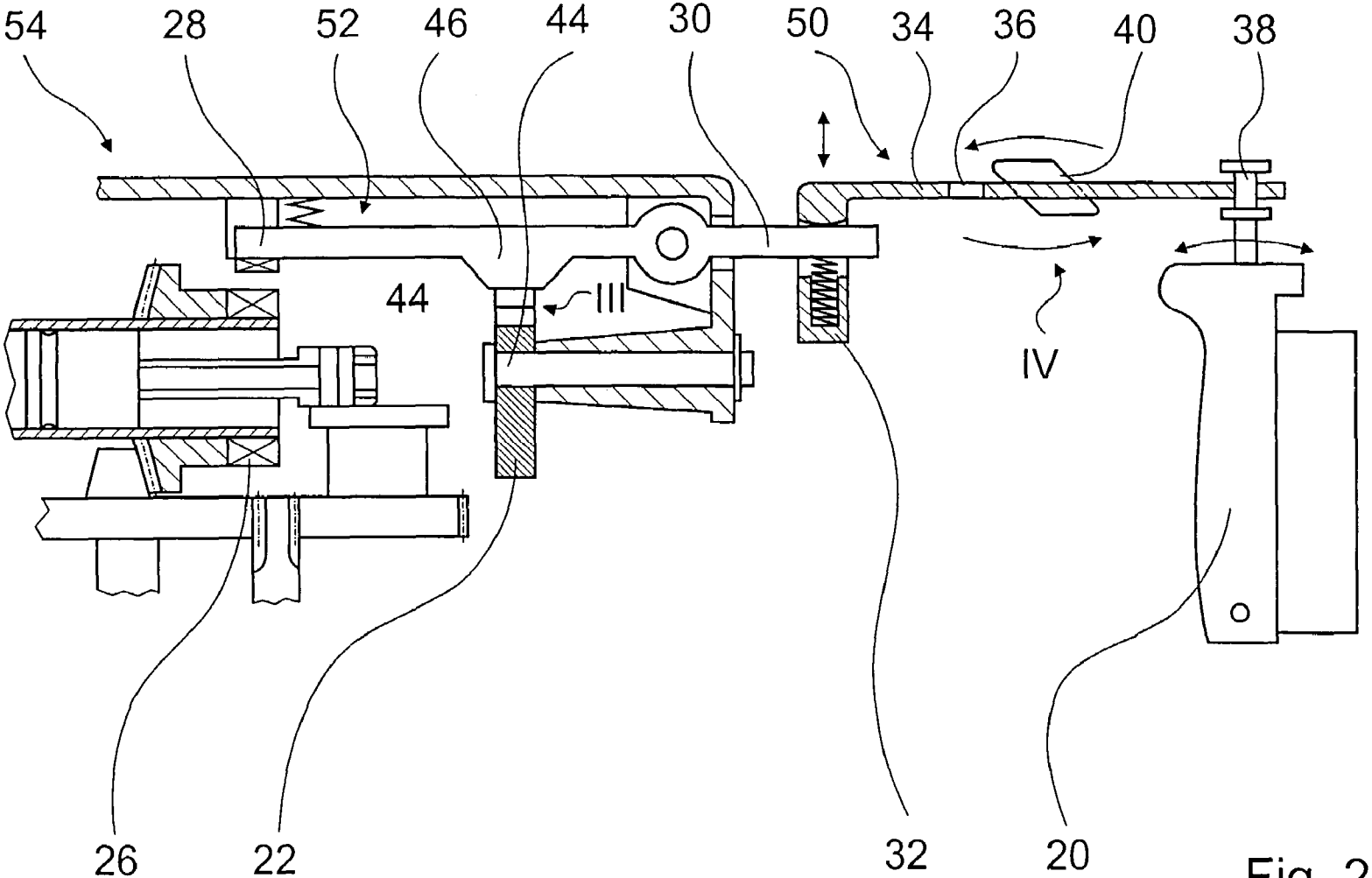
FIG. 2, schematically, a preferred guard device with a mechanical sensor unit, a mechanical blocking unit, and a mechanical unlocking unit, in section.

With the guard device 54, an uncontrollable blockage of the tool insert 12 can be detected via a sensor unit 22, and the housing 10 can be blocked in its motion; preferably, the electric motor is switched off. A preferred guard device 54 is shown in FIG. 2. A mechanical sensor unit 22 is operatively connected to a mechanical blocking unit 52. An especially preferred blocking unit 52 and the sensor unit 22 are described in Published German Patent Disclosure DE 43 00 021, whose disclosure is hereby expressly incorporated herein by reference. If the sensor unit 22 detects an uncontrollable blockage, the sensor unit 22 trips and activates a blocking unit 52. The blocking unit 52 includes a resiliently and rotatably supported detent lever 28, which has a blocking serration 26 on one end. Because it is supported rotatably, the detent lever 28 can execute an up-and-down motion. In addition, a lateral brace, not shown, may be provided in order to prevent lateral deflection of the detent lever 28. The detent lever 28 is in contact with the sensor unit 22 between the blocking serration 26 and where the detent lever is supported. On the end opposite from the blocking serration 26, the detent lever 28 is provided with an extension 30, with which an unlocking unit 50 meshes.

The unlocking unit 50 includes a switching rod 34, which on an end remote from the extension 30 is secured by an actuating pin 38 to the on/off switch means 20, embodied as a switching latch, and is supported longitudinally displaceably along the axis of rotation 14 (FIG. 1). With a connecting part 32, the switching rod 34 meshes with the extension 30 and reaches through an opening in the extension 30.

Figure 4:
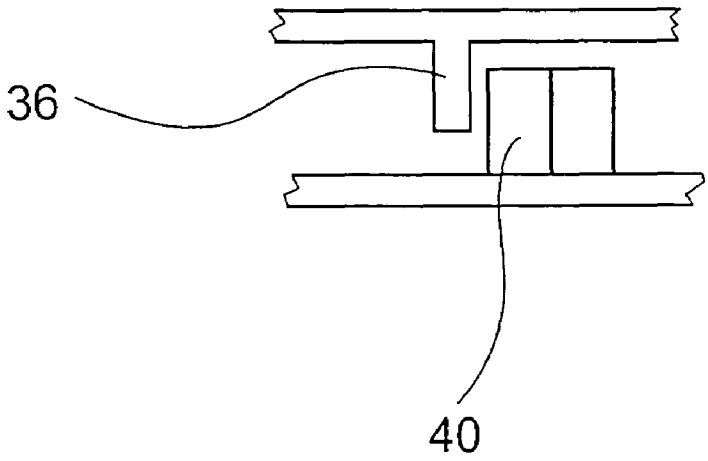
FIG. 4, a detail of the switching rod.

In the switching rod 34, a switching pawl 36 and a switching cam 40 are provided, with which a motion in the longitudinal direction, tripped by an actuation of the on/off switch means 20, embodied as a switching latch, is convertable into an up-and-down motion, with a first, upper position and a second, lower position. The switching pawl 36 and the switching cam 40 are shown in detail in FIG. 4. By means of an on-off-switching motion of the on/off switch means 20, embodied as a switching latch, the switching rod 34 is moved in the longitudinal direction. The resultant up-and-down motion actuates a so-called reset of the guard device.

Figure 3:
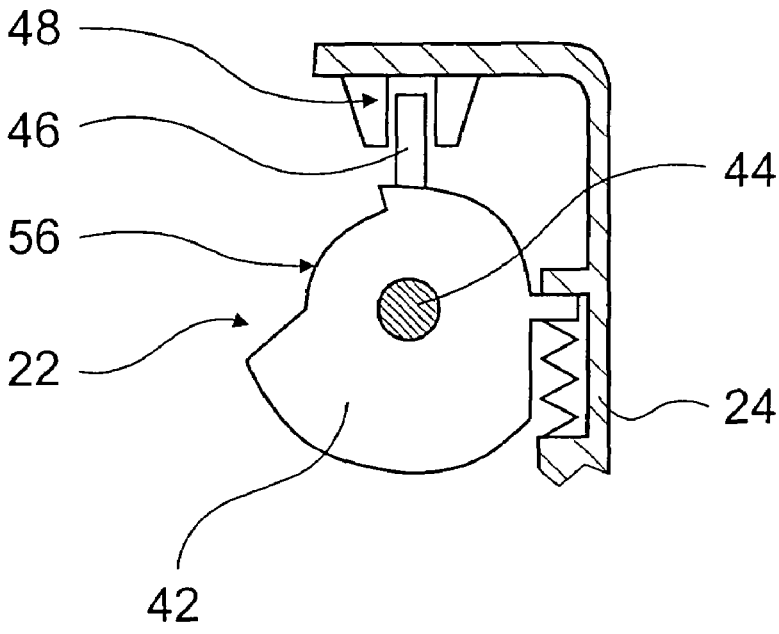
FIG. 3, a detail of the mechanical sensor unit of Published German Patent Disclosure DE 43 00 021 A1, incorporated herein by reference.

The sensor unit 22 is shown in a detailed view in FIG. 3. Its functional principle is described in DE 43 00 021 A1, whose content is incorporated herein by reference. The blocking unit 52 rests, with the detent pawl 46 provided on the detent lever 28, on the circumference of a disk 42 and with this disk can engage a recess 56. The spacing between the detent lever 28 and the disk 42 is variable, depending on whether the detent pawl 46 is contacting the circumference or the inside of the recess 56. The retainer 48 on the side prevents lateral deflection. In the position shown, the spacing is great, and the detent lever 28 is pressed upward by the detent pawl 46. If when a blockage is detected the disk 42 rotates to the left, then the detent pawl 46 engages the recess 56 of the disk 42. The detent lever 28 moves downward, and the blocking serration 26 is activated.

Resetting and activation of the guard device 54 are done as follows: If an uncontrollable blockage has occurred, and the on/off switch means 20 embodied as a switching latch is still being pressed by the user but the electric motor has already been switched off and the user is trying to the hand power tool on again, the user must first release the on/off switch means 20 embodied as a switching latch. The upward motion of the switching rod 34 into the upper position that is thus initiated has no effect. The user now takes the hand power tool into his hands and switches the hand power tool on. The onset of the activation motion causes the switching rod 34 to be pressed downward by the switching cam 40 and the serration of the detent lever 28 to be lifted out of the blocking serration 26. The restoring spring 24 puts the sensor unit 22 back in its outset position, and the guard device 54 is again ready for operation. By the further activation motion of the on/off switch means 20 embodied as a switching latch, the electric motor is switched on, and the operation of the hand power tool is continued. If immediately after that an uncontrollable blockage again occurs, the guard device 54 can react again immediately. A preferred hand power tool is in particular a drill hammer or a percussion drill. However, the guard device 54 is also suitable for other power tools that have tool inserts that can be driven to rotate, such as right-angle and eccentric grinders, circular saws, chainsaws, and the like.

LIST OF REFERENCE NUMERALS

10 Housing
12 Tool insert
14 Axis of rotation
16 Tool retainer
18 Grip
20 On/off switch means
22 Sensor unit
24 Restoring spring
26 Blocking serration
28 Detent lever
30 Extension
32 Connecting part
34 Switching rod
36 Switching pawl
38 Actuating pin
40 Switching cam
42 Disk
44 Pin
46 Detent pawl
48 Retainer
50 Unlocking unit
52 Blocking unit
54 Guard device
56 Recess

The invention claimed is:

1. A hand power tool, comprising a housing; an electric motor located in said housing; a tool insert located in a tool retainer and drivable in rotation; a guard device detecting a blockage of said tool insert via a sensor unit and blocking a motion of said housing, said guard device including a mechanical unlocking unit that is manually actuatable by a user's actuating force; and a gear actuatable via an on/off switch means for actuating said unlocking unit.

2. A hand power tool as defined in claim 1, wherein said electric motor is switchable off when the motion of said housing is blocked, said electric motor being also switchable on said unlocking unit being automatically actuated via said on/off switch means when said electric motor is switched on.

3. A hand power tool as defined in claim 1, wherein said sensor unit of said guard device is configured as a mechanical sensor unit.

4. A hand power tool as defined in claim 1, wherein said sensor unit of said guard device includes a restoring spring.

5. A hand power tool as defined in claim 1, wherein said sensor unit of said guard device is an electrical sensor unit.

6. A hand power tool as defined in claim 1, wherein said guard device includes a mechanical blocking unit.

7. A hand power tool as defined in claim 6, wherein said blocking unit includes a rotatably supported detent lever with a serration for meshing with a blocking serration on one end and an extension on a diametrically opposite end.

8. A hand power tool as defined in claim 1, wherein said guard device includes an electrical blocking unit.

9. A hand power tool as defined in claim 1, wherein said guard device includes a blocking unit, said unlocking unit having a switching rod with one end connected to said on/off switch means and another end operatively connected to said blocking unit.

10. A hand power tool as defined in claim 9, wherein said tool insert is drivable in rotation about an axis of rotation, said switching rod being supported longitudinally displaceably along said axis of rotation.

11. A hand power tool as defined in claim 9, wherein said switching rod has a switching pawl and a switching cam, with which a displacement in a longitudinal direction, tripped by an actuation of said on/off switch means, is convertible into an up-and-down motion having a first upper position and a second lower position.

12. A hand power tool as defined in claim 9, wherein said switching rod has one end provided with an actuating pin engaging said on/off switch means and another end provided with a connecting part engaging an extension of a detent lever.

13. A hand power tool as defined in claim 9, wherein said switching rod has an upper position and a lower position and is configured so that when said electric motor is switched off and said on/off switch means is tripped, said switching rod is located in said upper position.

14. A hand power tool as defined in claim 9, wherein said switching rod has an upper position and a lower position and is configured so that upon actuation of said on/off switch means, said switching rod is movable into said lower position and a detent lever is removable out of a blocking serration.

15. A hand power tool as defined in claim 1, further comprising a clutch which, for blocking the motion of said housing, interrupts a flow of torque.

16. A hand power tool as defined in claim 1, further comprising an electrical component, wherein an element selected from the group consisting of said electric motor, said electrical component, and both is switchable off in an event of blockage of said tool insert.

* * * * *